US008610297B2

(12) United States Patent
Biessenberger et al.

(10) Patent No.: US 8,610,297 B2
(45) Date of Patent: Dec. 17, 2013

(54) STARTER FOR AN INTERNAL COMBUSTION ENGINE

(75) Inventors: Thomas Biessenberger, Schorndorf (DE); Hartmut Wanner, Herrenberg-Oberjesingen (DE); Uwe Daurer, Kornwestheim (DE); Oliver Neumann, Heilbronn (DE)

(73) Assignee: Robert Bosch GmbH, Stuttgart (DE)

( * ) Notice: Subject to any disclaimer, the term of this patent is extended or adjusted under 35 U.S.C. 154(b) by 546 days.

(21) Appl. No.: 12/992,820

(22) PCT Filed: May 6, 2009

(86) PCT No.: PCT/EP2009/055472

§ 371 (c)(1), (2), (4) Date: Feb. 1, 2011

(87) PCT Pub. No.: WO2009/138346

PCT Pub. Date: Nov. 19, 2009

(65) Prior Publication Data

US 2011/0115238 A1 May 19, 2011

(30) Foreign Application Priority Data

May 14, 2008 (DE) ..... 10 2008 001 750

(51) Int. Cl.
*F02N 11/00* (2006.01)

(52) U.S. Cl.
USPC ..... 290/38 R; 290/31

(58) Field of Classification Search
USPC ..... 290/30 R, 31, 38 R; 74/6
See application file for complete search history.

(56) References Cited

U.S. PATENT DOCUMENTS

| | | | | |
|---|---|---|---|---|
| 5,720,247 | A | 2/1998 | Suzuki et al. | |
| 5,818,679 | A | 10/1998 | Schustek et al. | |
| 8,004,378 | B2 | 8/2011 | Wanner | |
| 8,368,237 | B2 * | 2/2013 | Biessenberger et al. | 290/38 R |
| 2004/0017086 | A1 | 1/2004 | Shiga et al. | |
| 2008/0127927 | A1 | 6/2008 | Hirning et al. | |
| 2008/0283012 | A1 | 11/2008 | Wanner | |
| 2010/0127808 | A1 | 5/2010 | Wanner | |
| 2012/0104769 | A1 * | 5/2012 | Wanner | 290/38 C |

OTHER PUBLICATIONS

PCT/EP2009/055472, International Search Report, dated Aug. 31, 2009, (6 pages).

* cited by examiner

*Primary Examiner* — Nicholas Ponomarenko
(74) *Attorney, Agent, or Firm* — Michael Best & Friedrich LLP

(57) ABSTRACT

The invention relates to a starter (10) for an internal combustion engine, comprising a starter motor (12) which can be coupled to the internal combustion engine by means of a pinion (22), and a device for engaging the pinion (22) in a gear rim (26) of the internal combustion engine and connecting the starter motor (12) to a DC voltage supply system (30, 31). In order to disconnect the sequence of operations, the device has separate means, in particular separate relays (57, 64; 60), for engaging the pinion (22) on one hand and turning on the starter motor on the other when the internal combustion engine is started, thus preventing reactions of the engagement dynamics on the contact system when the motor current is switched.

15 Claims, 6 Drawing Sheets

STARTER FOR AN INTERNAL COMBUSTION ENGINE

BACKGROUND OF THE INVENTION

The invention relates to a starter for an internal combustion engine. By way of example, one such starter is described in the Kraftfahrtechnischen Taschenbuch (Motor vehicle manual) produced by Bosch, 25$^{th}$ edition, page 986, in the form of a pre-engaged Bendix starter, which is operated via a so-called pull-in relay. This relay carries out the pulling-in functions, that is to say engaging the pinion of the starter motor in the toothed rim on an internal combustion engine, and switching the main current of the starter motor. In this case, a distinction can be drawn between two possible processes when the pinion engages in the toothed rim: in about 20%-30% of switching operations, one tooth of the pinion engages in a gap in the toothed rim, while, in approximately 70%-80% of the switching operations, one tooth of the pinion strikes a tooth on the toothed rim during engagement, and the engagement process must be assisted by an engagement spring. This known starter design admittedly requires only a single relay and can therefore be produced at relatively low cost, but on the other hand it results in very difficult working conditions for the switching process for the high motor current on the switching contact which connects the motor windings to the voltage source. Particularly in the case of partially discharged batteries and as the mechanical wear on the engagement parts increases, the dynamic response when switching on the main starter current can decrease to such an extent that the contacts are welded by arcs which occur during the switching process. On the other hand, if the pinion engages directly in the engine toothed rim, the dynamic response of the switching process and the contact wear resulting from it may possibly be high, depending on the design of the starter, when starting from an initial tooth-in-gap position.

In order to improve the switching-on process, particularly in the case of high-power starters, it is also known from the abovementioned reference for the motor current to be switched on in two stages in so-called pre-engaged starters wherein, in a first stage, the pinion of the starter is moved against the toothed rim of the engine, and the armature of the starter motor is at the same time fed with a reduced current, as a result of which the armature and, with it, the pinion, rotate during the engagement process, thus simplifying the engagement process. The engagement mechanism is in this case provided with a ratchet which closes a further switching contact of the relay and, via this, the main current circuit of the motor, only at the end of the engagement process of the pinion. This allows the engagement process and the switching of the main current of the motor to be carried out in two separate processes, but the design of the pull-in relay is more complex and more susceptible to defects, from the mechanical and electrical points of view.

SUMMARY OF THE INVENTION

The starter according to the invention, has the advantage that the processes for engagement of the pinion on the one hand and the switching of the motor current on the other hand are completely decoupled by the use of separate means for this purpose, in particular by the use of separate relays, in which case, the types of relay can be optimally matched to the respective process steps. However, it is also possible to use suitable semiconductor components, preferably transistors or GTO (Gate Turn Off) thyristors, for switching relatively high currents for all of the switching means, or for individual switching means. In particular, this makes it possible to completely separate the switching function for the high main motor current during starting of the internal combustion engine from the engagement process, thus avoiding reactions from the engagement dynamics on the contact system of the relay. The speed at which the contacts close is in this case independent of the engagement situation.

It is particularly advantageous for the switching relay in the main circuit of the starter motor to be activated by the engagement relay itself at the end or shortly before the end of the engagement movement, and in this case for the starter motor to be connected directly to the voltage source. With little additional complexity, this results in exact interaction between the engagement movement of the pinion and the process of switching on the main starter current at the end of the engagement movement. The engagement relay is for this purpose expediently equipped with a holding winding and a separate pull-in winding, which jointly operate a switching contact for activation of the switching relay. The holding winding and the engagement winding are preferably seated on the same relay core, and are in this case selectively switched in the same sense or in opposite senses. If they are switched in the same sense, the required total flux is achieved with a smaller number of turns and/or a lower excitation current while, if the fluxes are opposite, the winding with the lesser flux can be used to damp the switching process. The numbers of turns and the excitation currents for the holding winding and the pull-in winding are in this case expediently chosen such that the holding winding produces the switching process of the engagement relay with a large number of turns and an adequate excitation current, while the pull-in winding is equipped with considerably fewer turns, but carries a considerably higher excitation current, which is sufficient to easily rotate the armature during engagement.

One particularly simple and cost-effective circuit design is obtained by current being passed through the starter motor in a single stage, in which case the pull-in winding of the engagement relay is connected in series with a series winding of the starter motor, as a bias resistance, and both windings of the engagement relay jointly switch a make contact, via which current is passed to the winding of the switching relay, and the starter motor is supplied with the entire motor current at the end of the pull-in movement of the engagement relay. As is known, an arrangement such as this requires an engagement spring which, in conjunction with a steep-pitched thread, in particular when the pinion and the toothed rim are in a so-called tooth-on-tooth position, assists the engagement process, before suddenly switching on the main current for the motor.

A particularly protective engagement process is achieved by passing current through the starter motor in two stages in a manner which is known in principle, in which case, in a first switching stage, a limited rotation current for the starter armature flows via a normally-closed contact and the pull-in winding of the engagement relay. In a second stage, current is subsequently passed through the separate switching relay via a make contact of the engagement relay at or shortly before the end of the pulling-in movement of the relay armature, and the full motor current is supplied to the starter motor. In this case, the two separate relays can be optimally designed in accordance with the different requirements.

BRIEF DESCRIPTION OF THE DRAWINGS

Further details and advantageous refinements of the invention will become evident from the dependent claims and the description of the exemplary embodiments, which will be explained in more detail in the following description and are illustrated in the drawings, in which:

DETAILED DESCRIPTION

Figure 1:
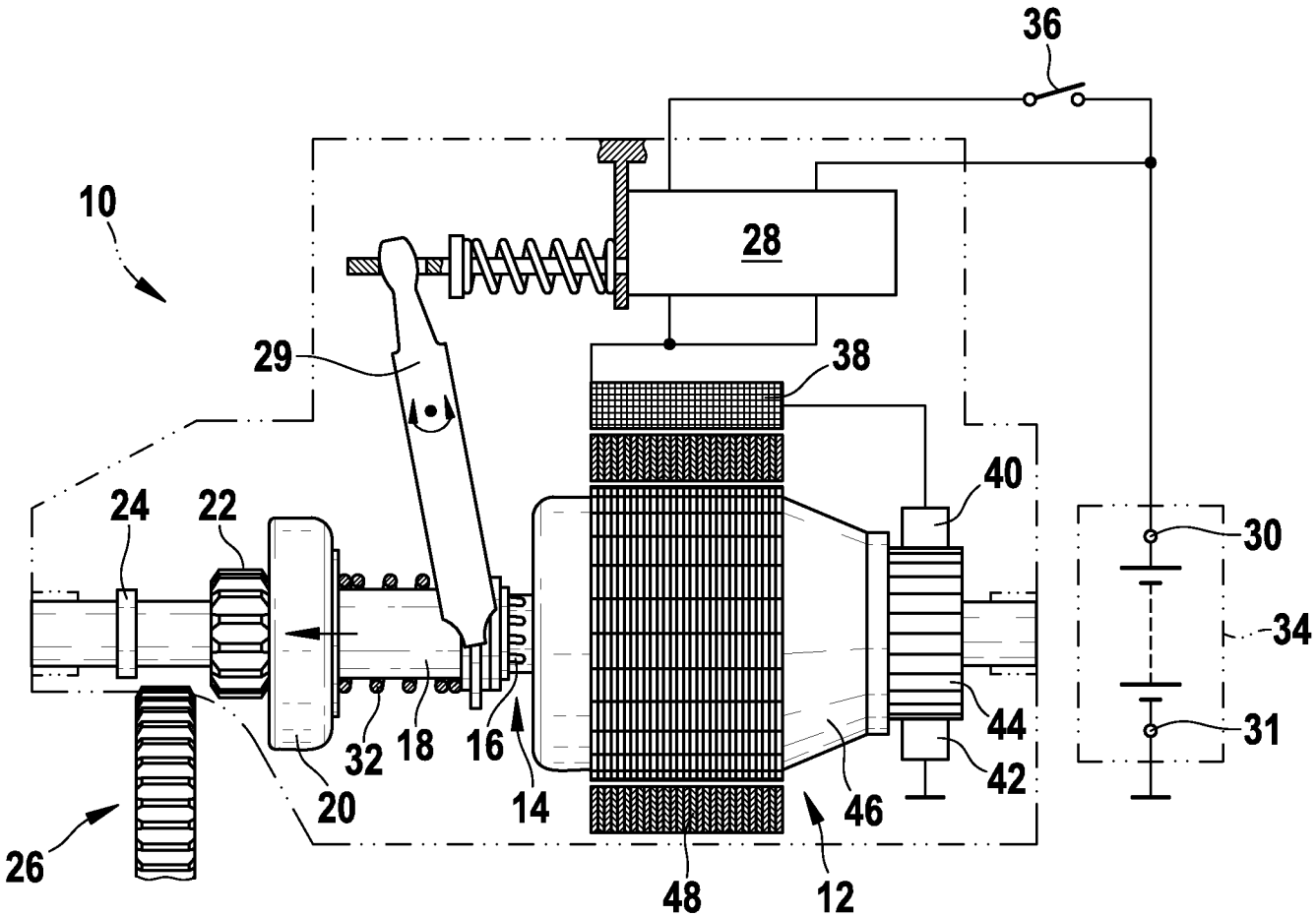
FIG. 1 shows an outline illustration of a pre-engaged Bendix starter with a series winding.

FIG. 1 schematically illustrates the mechanical design of the starter 10 according to the invention, in the form of a pre-engaged Bendix starter for an internal combustion engine. The starter 10 has a starter motor 12 whose output drive shaft 14 has a steep-pitched thread 16 which interacts with a corresponding female thread in a driver shaft 18. Alternatively, the output drive shaft 14 is driven via an epicyclic gearbox, which is connected in between, but is not illustrated. The driver shaft 18 is firmly connected to the outer ring of a freewheeling ring 20, whose inner ring is fitted with a pinion 22. The pinion 22 and the freewheeling mechanism 20 are mounted on the output drive shaft 14 such that they can move axially as far as a stop 24. The pinion 22 in this case engages in a toothed rim 26 of an internal combustion engine, which is not illustrated. The axial movement takes place with the aid of a relay arrangement 28, which is illustrated in detail in the following figures and acts on the freewheeling mechanism 20 via a direction-changing lever 29 and an engagement spring 32. A battery is used as the voltage source 34 for the arrangement; the negative pole 31 of the battery is connected to ground, and its positive pole 30 is connected on the one hand directly and on the other hand via an ignition/starter switch 36 to the relay arrangement 28. A series winding 38 is fed via the relay arrangement and is connected to ground via brushes 40, 42 and via the commutator 44 of the motor. The armature of the starter motor 12 is annotated 46, and its stator is annotated 48.

Figure 2:
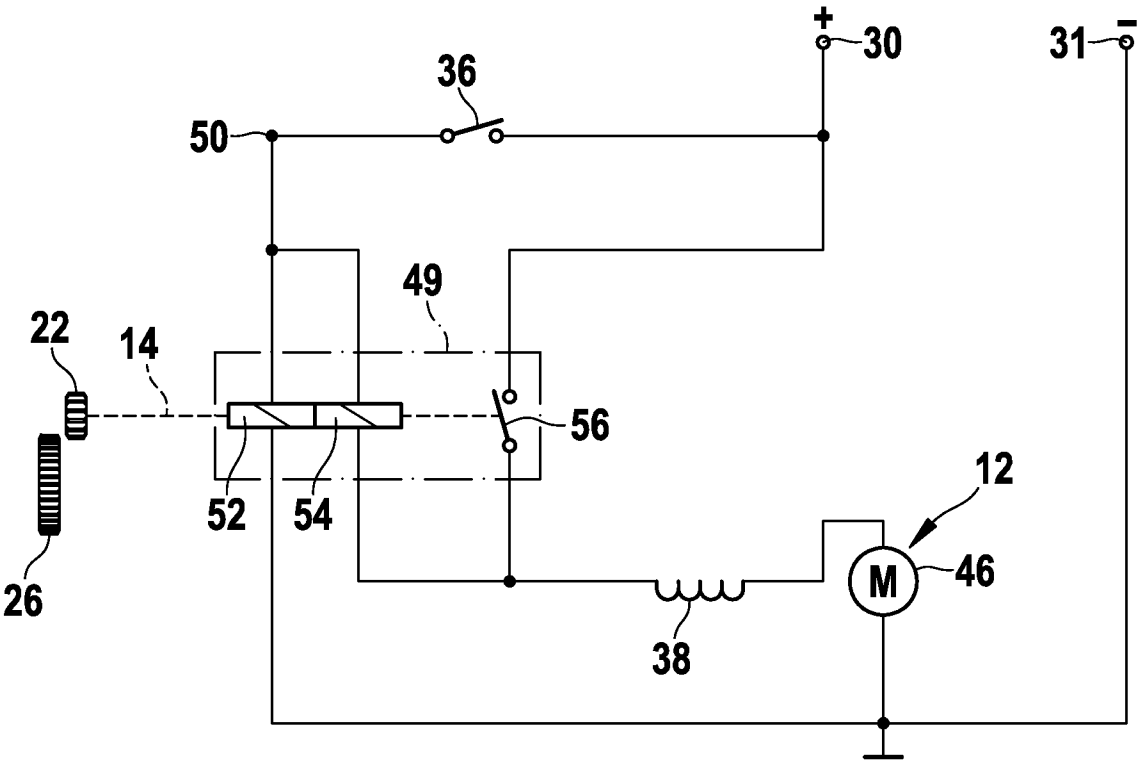
FIG. 2 shows a circuit diagram of a conventional embodiment of a starter through which current is passed in a single stage.

FIG. 2 shows a circuit diagram of a conventional embodiment of a starter through which current is passed in a single stage. In this case, the positive pole 30 of the voltage source is connected to an engagement relay 49, on the one hand via the ignition/starter switch 36 and a connection 50, and on the other hand directly. This engagement relay 49 contains a holding winding 52 and a pull-in winding 54, which are wound in the same sense, are wound on the same core, and are both connected at one winding end to the connection 50. The other winding end of the holding winding 52 is connected to the negative pole 31 and to ground, and the corresponding other winding end of the holding winding 54 is connected to the negative pole 31 and to ground via the series winding 38 and the armature 46 of the starter motor 12. The holding winding and the pull-in winding jointly operate a make contact 56 in the engagement relay 49, via which the starter motor 12 is connected directly to the positive pole 30 as soon as the relay armature has pulled in entirely or virtually entirely, and the pinion 22 has engaged in the toothed rim 26.

The holding winding 52 and the pull-in winding 54 in this known arrangement together carry out the task of engagement of the pinion 22 in the toothed rim 26 on the internal combustion engine, and at the same time the function of switching the main current for the starter motor 12. If, during this process, a tooth of the pinion 22 meets a gap in the toothed rim 26, then only a small amount of force is required for engagement, and the dynamic response during switching of the contact 56 is relatively high. On the other hand, the dynamic response during switching of the contact 56 is very low when, during engagement, a tooth on the pinion 22 strikes a tooth on the toothed rim 26, as a result of which the engagement spring 32, as shown in FIG. 1, must also be stressed during engagement, and only a small amount of energy is available for operation of the make contact 56. In consequence, relatively long-lasting arcs and welding can occur, which adversely affect the operation of the starter, at least in the long term.

Figure 3:
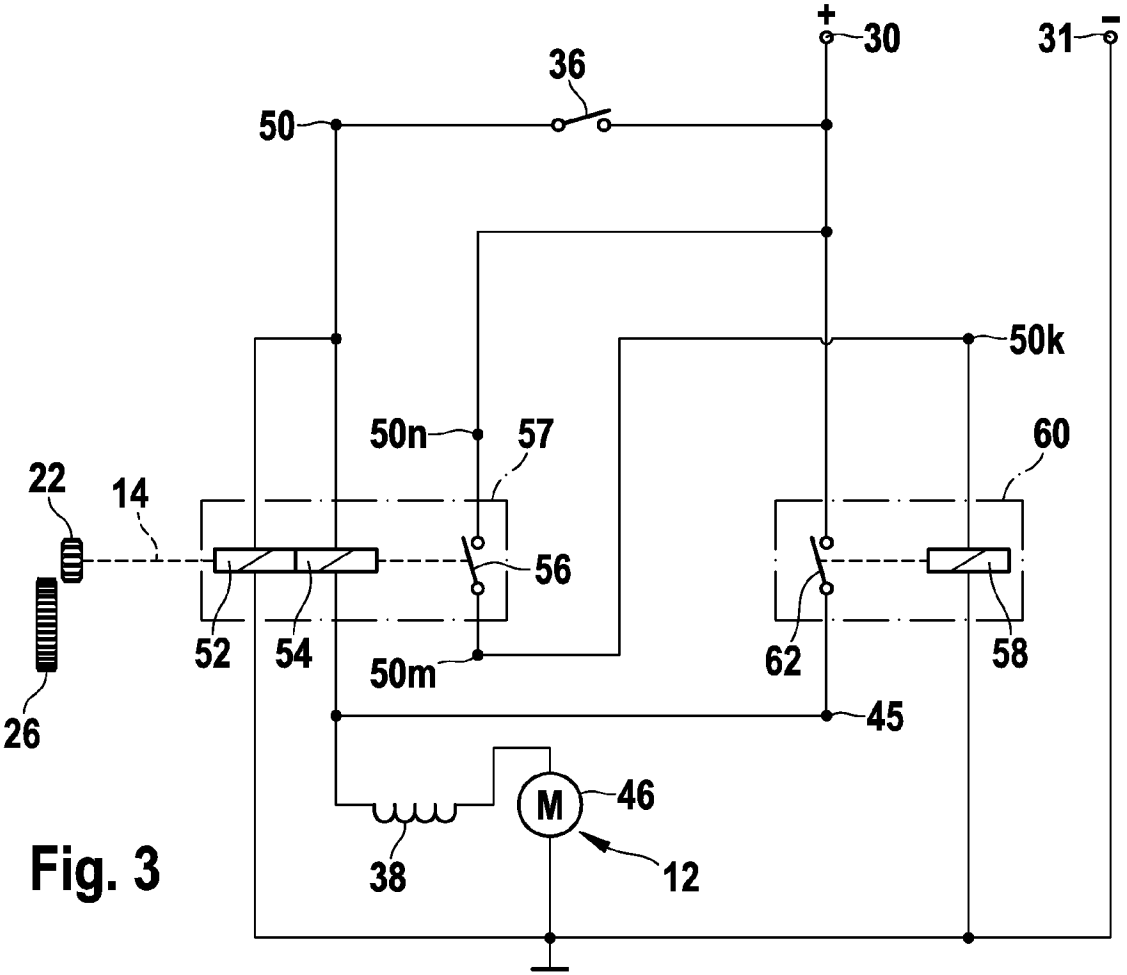
FIG. 3 shows a circuit diagram of an embodiment according to the invention of a starter through which current is passed in a single stage.

FIG. 3 shows the circuit diagram of an embodiment according to the invention of a starter through which current is passed in a single stage, and which overcomes the difficulties described above. In principle, with an engagement relay 57 and its connection to the DC voltage power supply system 30, 31, the design of the circuit arrangement corresponds to that in FIG. 2, but in this arrangement the relay contact 56 does not carry out the switching function for the high motor current, but only for passing current through the winding 58 of a switching relay 60, which then switches the motor current via its make contact 62. In addition, this arrangement operates in only one stage, with the pinion 22 engaging in the toothed rim 26 in the same way as in the arrangement shown in FIG. 2, and with the motor current being switched on completely at the end or shortly before the end of the engagement movement of the pinion 22. In contrast to the arrangement shown in FIG. 2, in addition to the engagement work for the pinion 22, however, the engagement relay 57 only has to operate the lightly loaded contact 56, and the actual process of switching on the motor current is carried out by the switching relay 60, as a result of which the functions of engagement and switching are completely separate, and the engagement process does not cause any reaction on the contact system of the switching relay 60.

Figure 4:
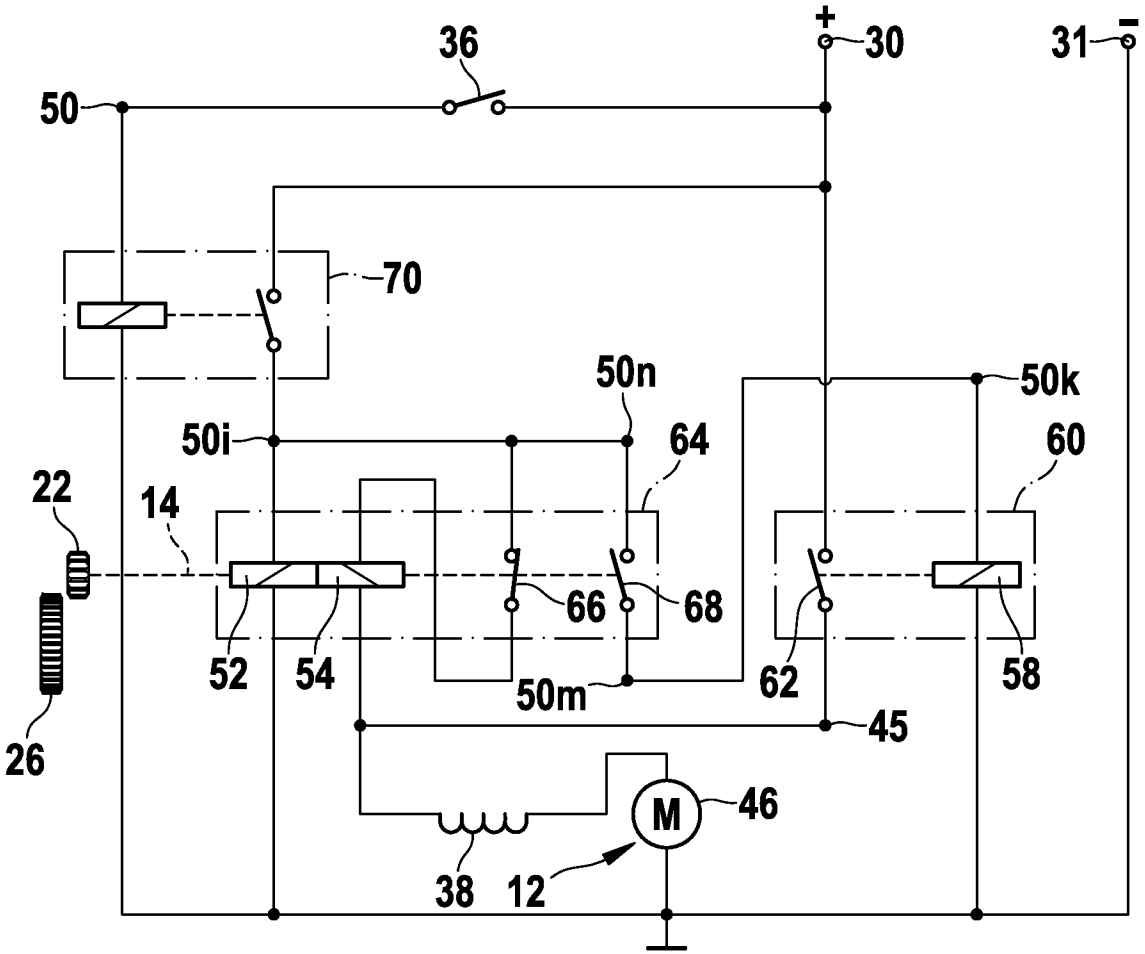
FIG. 4 shows a first circuit diagram of an embodiment according to the invention of a starter through which current is passed in two stages.

FIG. 4 shows a circuit arrangement for passing current through a starter motor 12 in two stages. In this case, instead of the engagement relay 57 for passing current in a single stage, as shown in FIG. 3, there is an engagement relay 64 with a normally-closed contact 66 and a make contact 68. The fixed connections of the contacts 66 and 68 can in this case be connected in parallel via a pilot control relay 70 to the positive pole 30, with one end of the relay winding being connected to the negative pole 31 and to ground, and the other end being connected via the connection 50 and the ignition/starter switch 36 to the positive pole 30 of the DC voltage power supply system. The holding winding 52 of the engagement relay 64 is likewise connected via the pilot control relay 70 to the positive pole 30 and to the negative pole 31 of the DC voltage power supply system.

In this embodiment, the two windings 52 and 54 of the engagement relay 64 are wound in opposite senses, with the holding winding 52 having a considerably greater number of turns than the pull-in winding 54 and being excited with a sufficiently high current in order to carry out the engagement process for the pinion 22 on its own, despite the flux in the opposite direction in the pull-in winding 54. In this case, the pull-in winding 54 advantageously damps the dynamic response of the engagement movement, and at the same time supplies a sufficiently high excitation current to the series winding 38 of the starter motor in order to rotate this slightly, and to simplify the engagement process, or to allow the engagement process. In this arrangement, an engagement spring can additionally be used in order to assist the engagement process.

Once again, the current flow through the starter motor 12 is provided by the switching relay 60, independently of the operation of the engagement relay 64. For this purpose, current is passed through the winding 58 of the switching relay 60 at the end or close to the end of the switching movement of the engagement relay 64, by closing its make contact 68 and opening the normally-closed contact 66, such that the switching relay 60 is supplied with its predetermined operating current via its make contact 62, without the engagement process adversely affecting the starter motor 12. Because the normally-closed contact 66 has been opened, there is no current through the pull-in winding 54 of the engagement relay 64, while its holding winding 52 remains excited until the ignition/starter switch 36 opens, and thus ensures that the starting process is continued.

The use of a pilot control relay 70 for the operation of the circuit arrangement as shown in FIG. 4 is not absolutely essential, and current can also be passed through the engagement relay 64 directly via the ignition/starter switch, analogously to the circuit arrangement shown in FIG. 3. On the other hand, in the first current-flow phase, the motor current via the pull-in winding 54 is in the order of magnitude of up to 200 A, which means that it is expedient to use a pilot control relay to bypass the ignition/starter switch 36 in the first stage of the current flow, at least for high-power starting motors.

Figure 5:
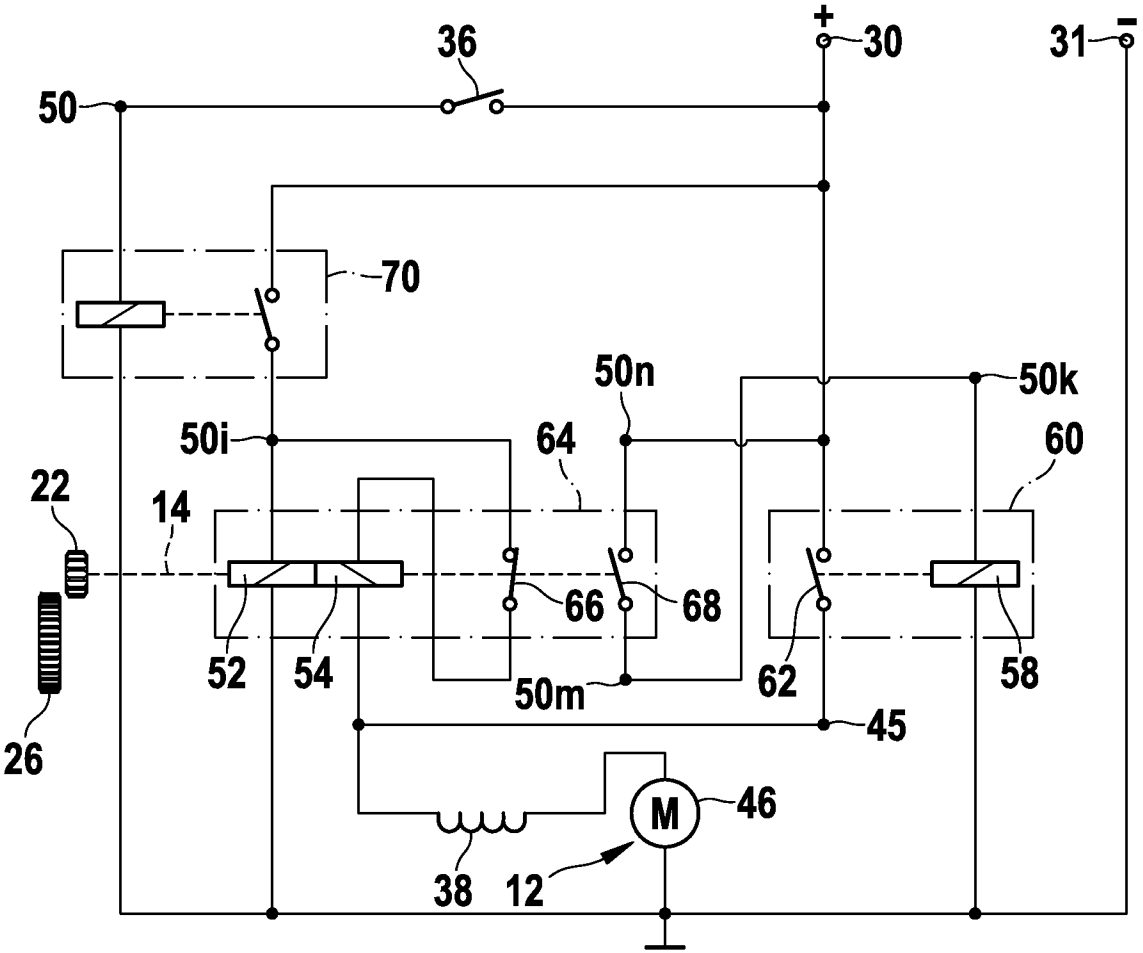
FIG. 5 shows a second circuit diagram of an embodiment according to the invention of a starter through which current is passed in two stages.

FIG. 5 shows a variant of the circuit arrangement from FIG. 4, which differs from the previously described embodiment in that the excitation current for the winding 58 of the switching relay 60 does not flow via the pilot control relay 70, but is tapped off directly from the supply line to the positive pole 30 of the voltage source. This admittedly has the disadvantage that an additional connection is required between the engagement relay 64 and the switching relay 60, but on the other hand it reduces the magnitude of the current via the engagement relay 64, and there is therefore no need for the pilot control relay 70, at least for relatively small types of motor. All the other functions of the circuit arrangement shown in FIG. 5 correspond to those in FIG. 4, and do not need to be explained again.

In order to explain illustrations in FIGS. 6 and 7, FIGS. 3 to 5 show additional connection points with the reference symbols 50*i*, 50*k*, 50*m* and 50*n*. In this case, the connection point 50*i* is connected to the fixed connection of the relay contact of the pilot control relay 70, the connection point 50*k* is connected to the winding connection of the switching relay 60, the connection point 50*m* is connected to one connection, and the connection point 50*n* is connected to the other connection, of the make contact of the engagement relay 57, or 64. These reference symbols make it easier to interpret the illustrations in FIGS. 6 and 7, in which case the switching contacts which are normally in practice in the form of double contacts or have a contact plate, are likewise illustrated schematically.

Figure 6:
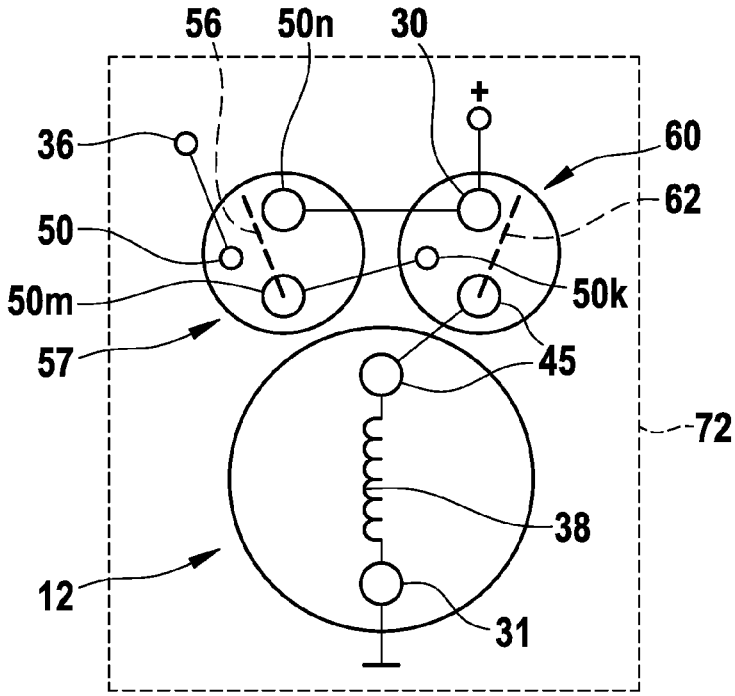
FIG. 6 shows an outline illustration of the spatial arrangement and connection of a starter according to the invention with an engagement relay and a switching relay.

FIG. 6 shows the design configuration of a starter according to the invention with a single-stage current flow corresponding to FIG. 3. In this case, the starter motor 12, the engagement relay 57 and the switching relay 60 form one unit 72, in which case either both relays 57 and 60 or one of them are or is integrated permanently in the housing of the starter motor 12, or is or are detachably connected to it. The internal design of the engagement relay 57, of the switching relay 60 and of the starter motor 12 are indicated symbolically by the respective connection points. For example, the engagement relay 57 receives its start signal via an external connection from the ignition/starter switch 36, as a result of which the make contact 56 is closed, and the connection points 50*m* and 50*n* are connected to one another for excitation of the relay.

In the switching relay 60, the positive pole 30 is connected via the make contact 62 to the connection point 45 on the relay, and this is externally connected to the starter motor 12 and, via its series winding 38, to the negative pole 31, and to ground.

Figure 7:
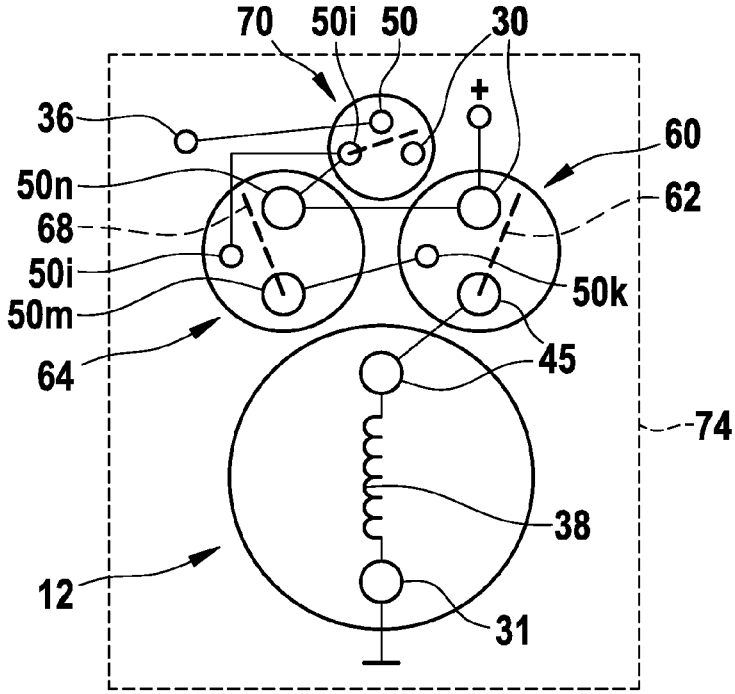
FIG. 7 shows an outline illustration of the spatial arrangement and connection of a starter as shown in FIG. 6, with an additional pilot control relay for passing current through the engagement relay.

FIG. 7 shows the spatial arrangement of a starter according to the invention through which current is passed in two stages, corresponding to FIG. 4 or 5. In this case, the pilot control relay 70, the engagement relay 64, the switching relay 60 and the starter motor 12 form one unit 74. Once again, the relays 70, 64 and 60 are selectively integrated individually or jointly in the housing of the starter motor 12, or are detachably connected to it. The illustration of the connection points and of the contacts corresponds to FIGS. 4 and 5, which differ only in the current supply to the make contact 68 in the engagement relay 64. The connection 50*n* in the engagement relay 64 is in this case selectively connected either to the connection point 50*i* on the pilot control relay 70, or directly to the positive pole 30 of the voltage source.

The invention claimed is:

1. A starter for an internal combustion engine, having a starter motor (12) which can be coupled via a pinion (22) to the internal combustion engine, and having an apparatus for engaging the pinion (22) in a toothed rim (26) of the internal combustion engine and for connection of the starter motor (12) to a DC voltage source (30, 31), characterized in that the apparatus has separate means (57, 64; 60) on the one hand for engaging the pinion (22) and on the other hand for switching on the starter motor (12) for starting the internal combustion engine.

2. The starter as claimed in claim 1, characterized in that the apparatus has separate engagement and switching relays (57, 64; 60) on the one hand for engaging the pinion (22) and on the other hand for switching on the starter motor (12).

3. The starter as claimed in claim 1, characterized in that a switching relay (60) in a main circuit of the starter motor (12) is activated, and the starter motor is connected directly to the voltage source (30, 31), by an engagement relay (57, 64), at or shortly before the end of its switching movement.

4. The starter as claimed in claim 2, characterized in that the engagement relay (57, 64) has a holding winding (52) and a pull-in winding (54), which jointly operate a switching contact (56; 66, 68) for activation of the switching relay (60).

5. The starter as claimed in claim 2, characterized in that the engagement relay (57) has a make contact (56) for activation of the switching relay (60) and for passing current through the starter motor (12) in a single stage.

6. The starter as claimed in claim 2, characterized in that the engagement relay (64) has a normally-closed contact (66) and a make contact (68) for passing current through the starter motor (12) in two stages, wherein, in a first stage, a limited motor current flows via the normally-closed contact (66) and the pull-in winding (54) of the engagement relay (64) and, in a second stage, the full motor current flows via the switching relay (60), which can be operated by the closed make contact (68) of the engagement relay (64), at or shortly before the end of the engagement movement.

7. The starter as claimed in claim 6, characterized in that, in the first switching stage, a limited motor current flows via the normally-closed contact (66) and the pull-in winding (54) of the engagement relay (64), and via a series winding (38) of the starter motor (12).

8. The starter as claimed in claim 2, characterized in that a series winding (38) and the armature (46) of the starter motor (12) are directly connected to the voltage source (30, 31) by the switching relay (60).

9. The starter as claimed in claim 1, characterized in that the apparatus has semiconductor switches as switching means (57, 64; 60).

10. The starter as claimed in claim 2, characterized in that the engagement relay (64) is preceded by a pilot control relay (70).

11. The starter as claimed in claim 10, characterized in that a winding (58) of the switching relay (60) can be connected to the voltage source (30, 31) via in each case one make contact of the pilot control relay (70) and of the engagement relay (64).

12. The starter as claimed in claim 10, characterized in that a winding (58) of the switching relay (60) can be connected directly to the voltage source (30, 31) via the make contact of the engagement relay (64).

13. The starter as claimed in claim 4, characterized in that the holding winding (52) and the pull-in winding (54) of the engagement relay (64) are wound in opposite senses, wherein the holding winding (52) produces the flux for switching the engagement relay (64), and the pull-in winding (54) damps the switching process.

14. The starter as claimed in claim 10, characterized in that the pilot control relay (70) and/or the engagement relay (57, 64) and/or the switching relay (60) forms/form one unit (72, 74) with the starter motor (12).

15. The starter as claimed in claim 14, characterized in that the pilot control relay (70) and/or the engagement relay (57, 64) and/or the switching relay (60) can be detachably connected to the starter motor (12).

* * * * *

UNITED STATES PATENT AND TRADEMARK OFFICE

CERTIFICATE OF CORRECTION

PATENT NO. : 8,610,297 B2
APPLICATION NO. : 12/992820
DATED : December 17, 2013
INVENTOR(S) : Biessenberger et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 623 days.

Signed and Sealed this
Twenty-second Day of September, 2015

Michelle K. Lee

Michelle K. Lee
*Director of the United States Patent and Trademark Office*